US011388986B2

(12) United States Patent
Rosen et al.

(10) Patent No.: US 11,388,986 B2
(45) Date of Patent: Jul. 19, 2022

(54) LIQUID DISPENSING HAIRBRUSH SYSTEMS AND ASSOCIATED DEVICES

(71) Applicant: MAXRO LLC, Columbus, OH (US)

(72) Inventors: Maxine Rosen, Highland Park, IL (US); Paul Reeder, Worthington, OH (US)

(73) Assignee: MAXRO LLC, Columbus, OH (US)

( * ) Notice: Subject to any disclaimer, the term of this patent is extended or adjusted under 35 U.S.C. 154(b) by 491 days.

(21) Appl. No.: 16/402,854

(22) Filed: May 3, 2019

(65) Prior Publication Data

US 2019/0335889 A1 Nov. 7, 2019

Related U.S. Application Data

(60) Provisional application No. 62/667,063, filed on May 4, 2018.

(51) Int. Cl.
*A46B 11/00* (2006.01)

(52) U.S. Cl.
CPC ..... *A46B 11/0037* (2013.01); *A46B 11/0041* (2013.01); *A46B 11/0065* (2013.01); *A46B 2200/104* (2013.01)

(58) Field of Classification Search
CPC ..... A46B 11/0037; A46B 11/0041; A46B 11/0065; A46B 2200/104
See application file for complete search history.

(56) References Cited

U.S. PATENT DOCUMENTS 2,998,822 A 9/1961 Birch et al.
4,294,270 A 10/1981 Cochran
5,746,531 A * 5/1998 Izhak ..... A46B 11/0058 132/112
5,927,290 A 7/1999 Thiruppathi
6,022,163 A 2/2000 Asfur
(Continued)

FOREIGN PATENT DOCUMENTS

GB 2209968 B 2/1991

OTHER PUBLICATIONS

Jocestyle Hair Dye Bottle Applicator 120ML with Graduated Salon Hair Coloring (1PC, Send in Random Color) by Jocestyle. <https://www.amazon.com/Jocestyle-Bottle-Applicator-Graduated-Coloring/dp/B01N2QHEFL/ref=pd_sim_194_3_encoding=UTF8&pd_rd_i=B01N2QHEFL&pd rdr=TB93EBSHAXJEP6AXXFTN&PD RD W=VXjqK&pd rd wg=4QaHT&psc=1&refRID=RB93EBSHAXJEP6AXXFTN> accessed on May 7, 2019, 1 page.
(Continued)

*Primary Examiner* — Nicholas D Lucchesi
(74) *Attorney, Agent, or Firm* — Perkins Coie LLP

(57) ABSTRACT

Hairbrushes that dispense liquid are disclosed herein. In some embodiments, a hairbrush system includes a brush body, a bristle support layer, and a liquid container configured to store a liquid. The bristle support layer includes a plurality of apertures and supports a plurality of bristles extending outwardly from the brush head. In some embodiments, the hairbrush is configured to transfer the liquid from the liquid container into a chamber defined by the brush body and the bristle support layer. In operation, the hairbrush transfers the liquid from the chamber through the plurality of apertures and into the bristles when the bristle support layer is compressed.

20 Claims, 7 Drawing Sheets

(56) References Cited

U.S. PATENT DOCUMENTS

| | | | | |
|---|---|---|---|---|
| 6,332,726 | B2 * | 12/2001 | Yamamoto | A45D 19/02 401/183 |
| 6,672,313 | B2 * | 1/2004 | Battaglia | A46B 11/0017 132/112 |
| 8,821,591 | B2 | 9/2014 | Iizaki et al. | |
| 9,067,709 | B2 | 6/2015 | Furusawa | |
| 9,210,982 | B2 | 12/2015 | Alsalameh | |
| 9,247,805 | B1 * | 2/2016 | Malm | A46B 11/0079 |
| 9,486,062 | B1 | 11/2016 | Piatetsky | |
| 10,638,831 | B2 * | 5/2020 | Pilevsky | A46B 9/028 |
| 2006/0210512 | A1 | 9/2006 | Luizzi et al. | |
| 2007/0068545 | A1 | 3/2007 | Dallianis et al. | |
| 2007/0144549 | A1 | 6/2007 | Enriquez | |
| 2013/0174860 | A1 * | 7/2013 | Takagi | A46B 11/002 132/200 |

OTHER PUBLICATIONS

Regrolix® Liquid-Dispensing Hairbrush (Black) by Regrolix. <https://www.amazon.com/Regrolix®-Liquid-Dispensing-Hairbrush-Blue/dp/B01IOIP770?th=1> accessed on May 7, 2019, 1 page.

Salon Care Root Comb Applicator—4 Ounce. <https://www.amazon.com/Salon-Care-Root-Comb-Applicator/dp/B01ENDFXJW/ref=cm cr_arp_d_product_sims?ie=UTF8> accessed on May 7, 2019, 1 page.

Club Roots HydroBrush, Liquid Dispensing Hair Brush for Hair Growth Treatments and Serums by Club Roots. <https://amazon.com/Club-Roots-HydroBrush-Dispensing-Treatments/dp/B01DXSC8BY> accessed on May 7, 2019, 1 page.

International Searching Authority, International Search Report and Written Opinion, PCT Patent Application PCT/US2019/030715, dated Jul. 12, 2019, 9 pages.

* cited by examiner

LIQUID DISPENSING HAIRBRUSH SYSTEMS AND ASSOCIATED DEVICES

CROSS-REFERENCES TO RELATED APPLICATIONS

The present application claims the benefit of U.S. Provisional Patent Application Ser. No. 62/667,063, filed on May 4, 2018, and titled "LIQUID DISPENSING HAIRBRUSH SYSTEMS AND ASSOCIATED DEVICES," the disclosure of which is incorporated herein by reference in its entirety.

TECHNICAL FIELD

The present technology is related to liquid dispensing hairbrush systems and associated devices. In particular, various embodiments of the present technology are related to liquid dispensing hairbrush systems with removable liquid containers.

BACKGROUND

Conventional hairbrushes are designed to smooth, style, and/or detangle human hair or animal fur and are often used with various types of hair products. For example, some hairbrushes can be used with styling products, such as hair spray, hair gel, and/or mousse. Hairbrushes can also be used with hair treatment products, such as dry shampoo, dry conditioner, hair coloring, and/or medicinal products (e.g., lice treatment products). With conventional hairbrushes, hair styling and/or treatment products are applied separately before, during, or after brushing the hair or fur.

DETAILED DESCRIPTION

The following disclosure describes various embodiments of liquid dispensing hairbrush systems and associated devices. Liquid dispensing hairbrush systems configured in accordance with embodiments of the present technology are configured to receive a liquid container in a handle of a brush body. As pressure is applied to the brush bristles, liquid from the container is dispensed onto a user's hair through one or more apertures in a layer of material supporting the bristles. In some embodiments, the back side of the brush body can include an aperture that enables the user to apply pressure to a bladder in the brush body to force liquid out of the apertures in the bristle support layer. When the liquid in the container is depleted, the user can remove the container from the handle and refill it with the same or a different liquid, and then replace the container back into the brush handle. Alternatively, the user can replace the container with new liquid container containing the same or a different liquid.

Specific details of several embodiments of the present technology are described herein with reference to FIGS. 1A-8. Although many of the embodiments are described with respect to systems and devices for human hair, other applications and other embodiments in addition to those described herein are within the scope of the present technology. For example, at least some embodiments of the present technology may be useful for brushing and/or treating animal fur, carpet, and/or other fibers. Accordingly, other embodiments in addition to those disclosed herein are within the scope of the present technology. Further, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology. In FIGS. 1A-8, many of the elements are not drawn to scale for purposes of clarity and/or illustration.

A. SELECTED EMBODIMENTS OF LIQUID DISPENSING HAIRBRUSH SYSTEMS AND ASSOCIATED DEVICES

Figure 1C:
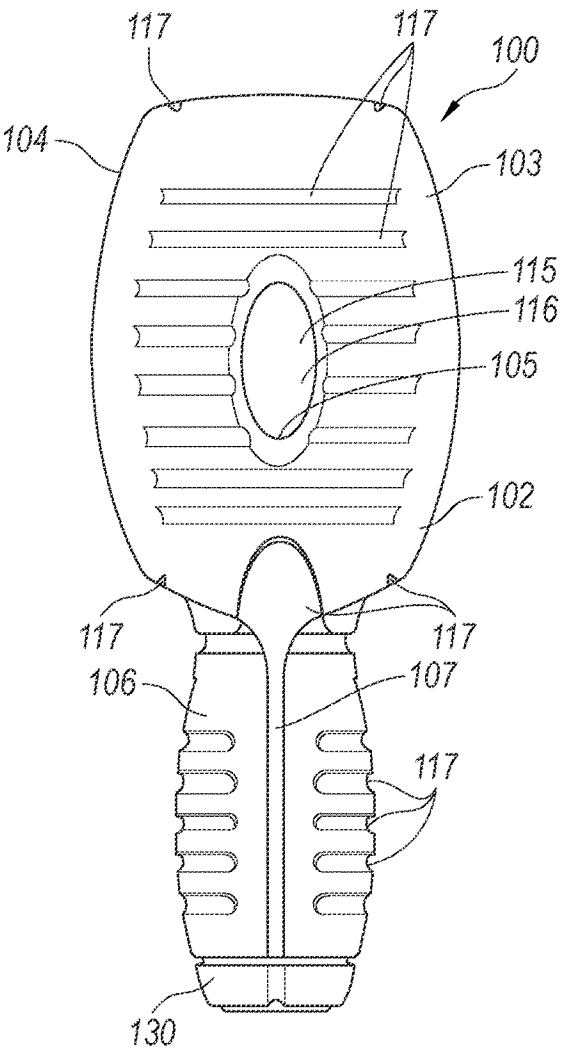
FIGS. 1A-1C are side, front, and rear views, respectively, of a liquid dispensing hairbrush system configured in accordance with an embodiment of the present technology.
Figure 1B:
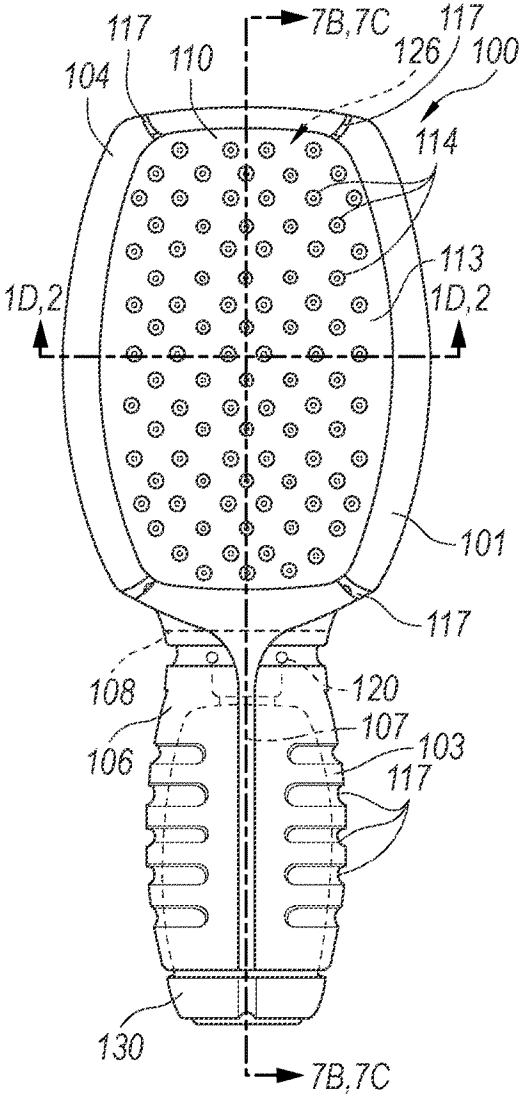
Figure 1A:
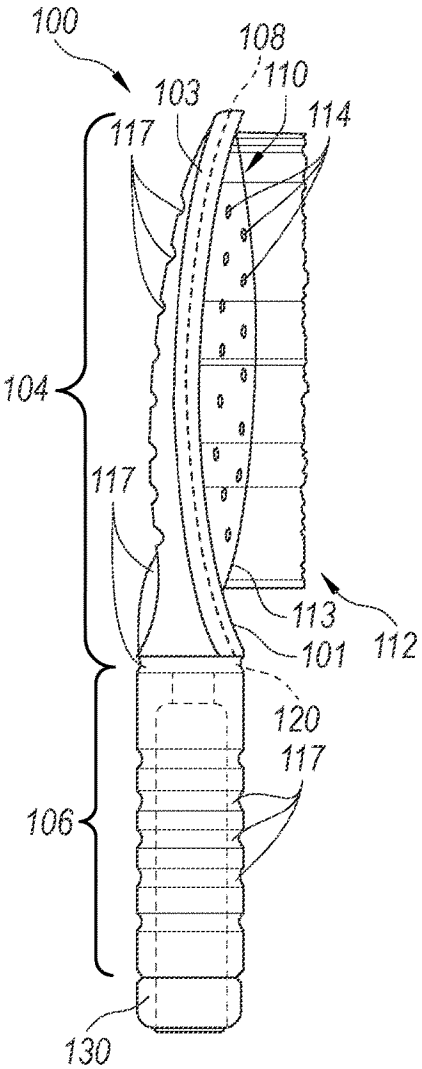
Figure 1D:
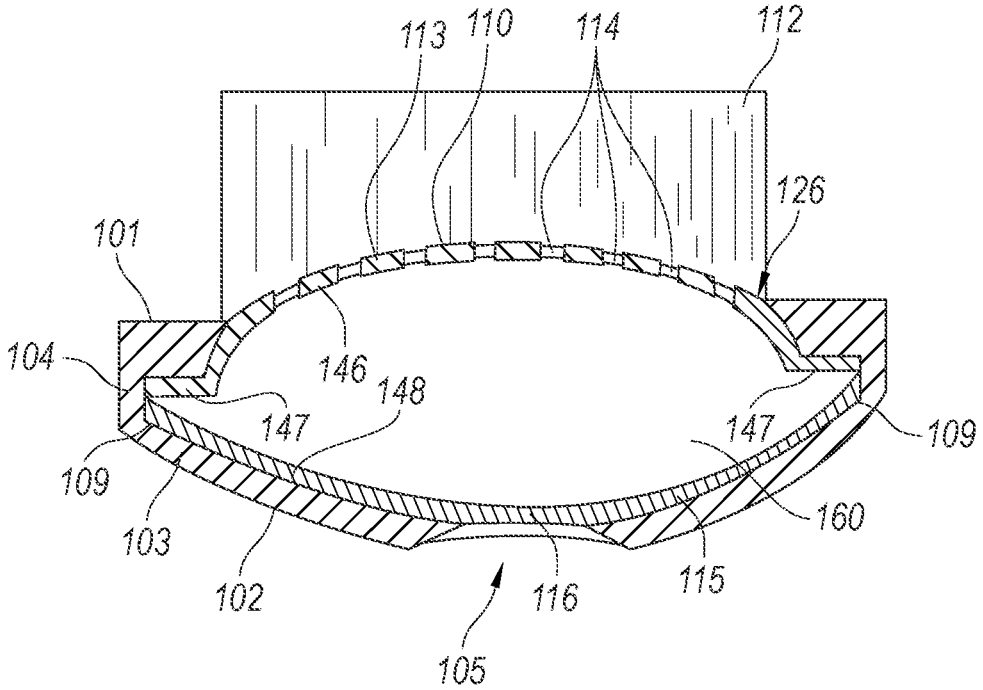
FIG. 1D is a cross-sectional view of a brush head of the hairbrush system taken along line 1D-1D in FIG. 1B.

FIGS. 1A-1C are side, front, and rear views, respectively, of a liquid dispensing hairbrush system 100 configured in accordance with an embodiment of the present technology, and FIG. 1D is a cross sectional view taken along line 1D-1D in FIG. 1B. Referring to FIGS. 1A-1C together, the hairbrush system 100 (which can also be referred to as a "hairbrush 100") includes a brush body 103, a bristle support layer 110, and a removable liquid container 130. The brush body 103 includes a brush head 104 and a handle 106. In some embodiments, the brush body 103 can additionally include one or more features 107 and/or 117 (e.g., recesses, ridges, protrusions, notches, etc.) that are aesthetic and/or functional by, for example, providing a gripping surface to the handle 106. In the illustrated embodiment, the brush body 103 is a unitary piece of polymer material (e.g., plastic) having a front side 101 (FIGS. 1A and 1B) and a back side 102 (FIG. 1C). In other embodiments, the brush body 103 and/or components of the brush body 103 can be made of a different material (e.g., a metal, composite, glass, wood, rubber, etc.). The brush body 103 can be formed by injection molding, and/or the brush body 103 can be cast, machined, carved, 3D-printed, or otherwise manufactured.

As shown in FIGS. 1C and 1D, the back side 102 of the brush head 104 can optionally include an aperture 105. In these embodiments, the hairbrush system 100 can include a bladder 115 attached to an inside surface 148 (FIG. 1D) of the back side 102 of the brush head 104. The bladder 115 can be sealably glued to the inside surface 148 using an adhesive. For example, the bladder 115 can be glued to the inside surface 148 at points 109 (FIG. 1D) along and/or near the periphery of the bladder 115. The bladder 115 is sized and shaped to (i) fit within the brush head 104 and (ii) to cover and seal off the aperture 105 such that liquid that enters a chamber 160 (FIG. 1D) in the brush head 104 cannot leak out via the aperture 105. In some embodiments, the bladder 115 can be made of a flexible polymer material (e.g., rubber, plastic, etc.). As described in greater detail below, the aperture 105 can be sized and shaped such that a user can press an exposed portion 116 of the bladder 115 through the aperture 105 and toward the front side 101 of the brush body 103 to increase pressure on liquid in the chamber 160 and to force the liquid through apertures in the bristle support layer 110 and onto the user's hair. In some embodiments, the bladder 115 can be transparent, so that a user can view whether there is liquid within the chamber 160 of the brush head 104 via the aperture 105.

Referring to FIGS. 1A, 1B, and 1D together, in the illustrated embodiment, the bristle support layer 110 is a unitary piece of polymer material (e.g., rubber, plastic, etc.). A plurality of bristles 112 extend outwardly from a front side 113 of the bristle support layer 110. The bristles 112 can be made from a flexible or rigid polymer material (e.g., plastic, rubber, etc.), fiberglass, metal(s), and/or other suitable materials known in the art. The bristle support layer 110 can include a plurality of apertures 114 between the bristles that pass from the front side 113 to a back side 146 (FIG. 1D) of the bristle support layer 110. Although the bristle support layer 110 is shown with a plurality of apertures 114 in the illustrated embodiment, in other embodiments, the bristle support layer 110 can include a greater or lesser (e.g., one, two, three, etc.) number of apertures 114 and/or can include the apertures 114 in different patterns and/or spacings than shown.

Referring to FIG. 1D, the bristle support layer 110 can be secured to the brush head 104 and/or to the bladder 115 using an adhesive and/or another method (e.g., using a heat sealer). More specifically, the periphery of the bristle support layer 110 can be bonded (e.g., glued) with an adhesive or otherwise sealably attached and secured to an inside lip on surface 147 of the brush body 103 and/or to the bladder 115 to create a water-tight seal along the periphery edges of the bristle support layer 110. The bristle support layer 110 is sized and shaped to fit within an opening 126 in the brush head 104. For example, the bristle support layer 110 can be flexed and/or folded to fit within the brush head 104 between the front side 101 and the back side 102 of the brush body 103.

Figure 2:
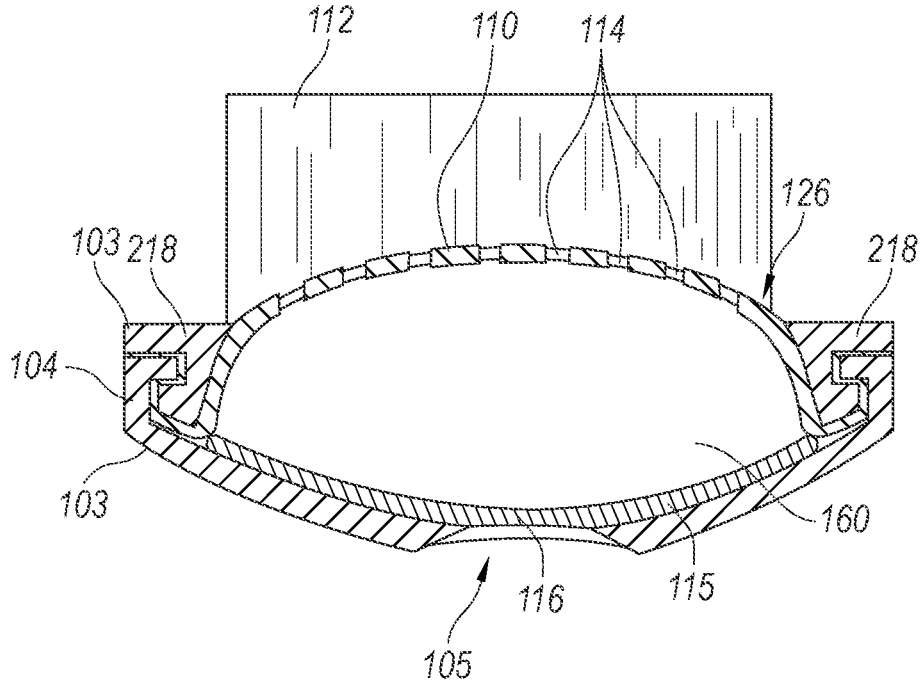
FIG. 2 is a cross-sectional view taken along line 2-2 in FIG. 1B of a brush head configured in accordance with another embodiment of the present technology.

FIG. 2 is a cross-sectional view along line 2-2 in FIG. 1B of the brush head 104 configured in accordance with an alternative embodiment of the present technology. In the illustrated embodiment, the brush body 103 can include an edge member 218. The edge member 218 can engage (e.g., snap, clip, clamp, etc.) with the brush head 104 (e.g., along dashed line 108 (FIGS. 1A and 1B)) to (i) secure the bristle support layer 110 and/or the bladder 115 to the brush head 104 by clamping (e.g., pinching) the bristle support layer 110 and/or the bladder 115 between the edge member 218 and the perimeter edge of the brush head 104 and (ii) form a watertight seal along the periphery edges of the bristle support layer 110 and/or the bladder 115. In some embodiments, an adhesive can be used (i) to secure the bristle support layer 110, the bladder 115, the edge member 218, and/or the brush head 104 together and/or (ii) to form and/or reinforce the watertight seal. In other embodiments, the bristle support layer 110 and/or the bladder 115 can be removable (i) so that a user can clean the bristle support layer 110, the bladder 115, and/or the brush head 104 and/or (ii) so that a user can replace the bristle support layer 110 and/or the bladder 115.

As described in greater detail below, the brush head 104, the bristle support layer 110, and/or the bladder 115 illustrated in FIGS. 1A-2 define the chamber 160 (FIGS. 1D and 2) of the brush head 104. The chamber 160 receives fluid from the liquid container 130 when the liquid container 130 is fully installed within the handle 106. In some embodiments, the system 100 can include a sponge (not shown) within the chamber 160 to facilitate distribution of liquid that enters the chamber 160 to the plurality of apertures 114 in the bristle support layer 110. After liquid enters the chamber 160, a user can force liquid out of the chamber 160 via the plurality of apertures 114 by applying pressure to the bristle support layer 110 and/or to the bristles 112. For example, the bristle support layer 110 can be compressed (via, e.g., pressure applied to the bristles 112), which forces liquid out of the plurality of apertures 114. Additionally or alternatively, a user can push on the exposed portion 116 of the bladder 115 through the aperture 105 to increase pressure applied to the liquid, forcing the liquid out of the plurality of apertures 114 in the bristle support layer 110.

Figure 3:
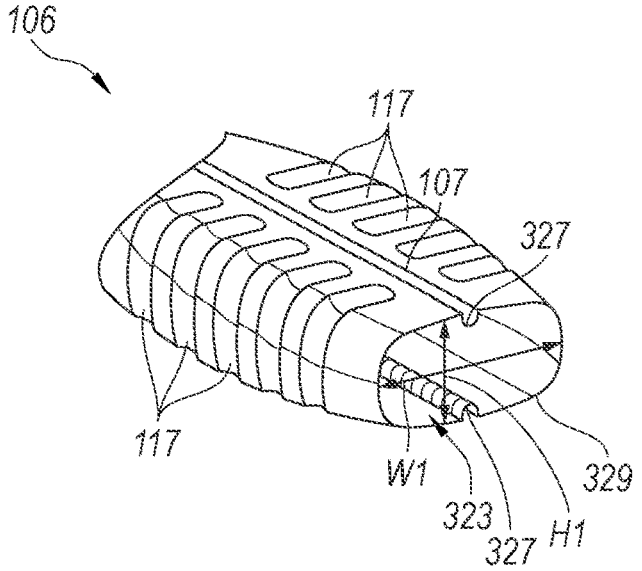
FIG. 3 is an isometric view of a brush handle configured in accordance with an embodiment of the present technology.

FIG. 3 is an isometric view of the handle 106 configured in accordance with an embodiment of the present technology. In the illustrated embodiment, the handle 106 includes a cavity 323 having an opening 329 with a width W1 and a height H1. The handle 106 additionally includes inwardly protruding ridges 327 that extend longitudinally along the handle 106. Although the handle 106 includes two ridges 327 in the illustrated embodiment, in other embodiments, the handle 106 can include a greater (e.g., three, four, etc.) or a fewer (e.g., one) number of ridges 327 and/or can include ridges 327 at other locations about a perimeter of the cavity 323.

As described in greater detail below, the ridges 327 are configured to align and/or register with corresponding grooves or recesses on the liquid container 130. In this manner, the handle 106 can be configured to receive liquid containers 130 having a particular size, shape, and/or orientation corresponding to the ridges 327 in the handle 106 and to the internal dimensions of the cavity 323. Thus, the ridges 327 and the dimensions of the opening 329 can limit use of the brush body 103 to liquid containers 130 of a particular brand, manufacturer, vendor, liquid, etc. Additionally or alternatively, the ridges 327 can align the liquid container 130 in a specific orientation within the handle 106 and prevent the liquid container 130 from rotating within the handle 106.

Although not shown, in some embodiments, the handle 106 can include one or more lips and/or one or more recesses that extend around at least a portion of the cavity 323 (e.g., near the opening 329 and/or at another location within the cavity 323). The lip(s) and/or recess(es) can engage corresponding features of the liquid container 130 to help retain the liquid container 130 within the cavity 323 of the handle 106. Additionally or alternatively, the lip(s) and/or recesses can be configured to limit use of the brush body 103 to liquid containers 130 of a particular size, shape, and/or manufacturer.

Figure 4A:
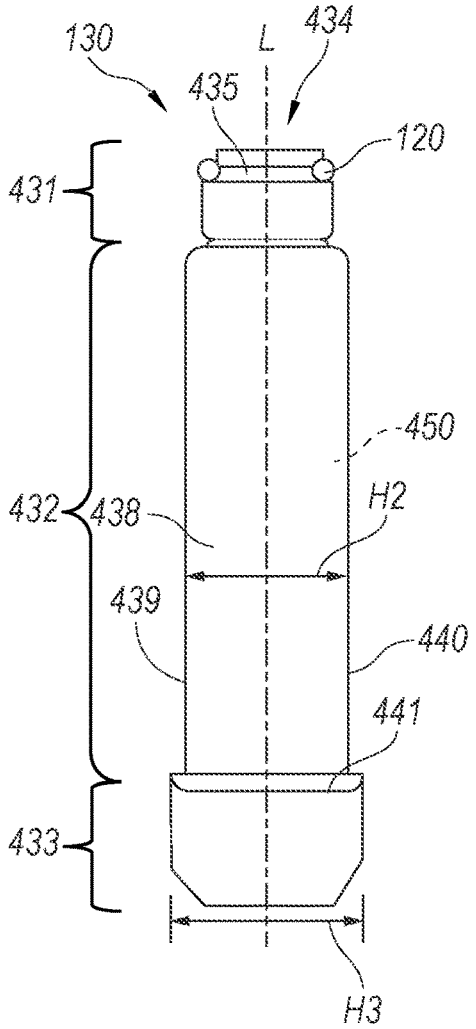
FIGS. 4A and 4B are side and front views, respectively, of a liquid container configured in accordance with an embodiment of the present technology.
Figure 4B:
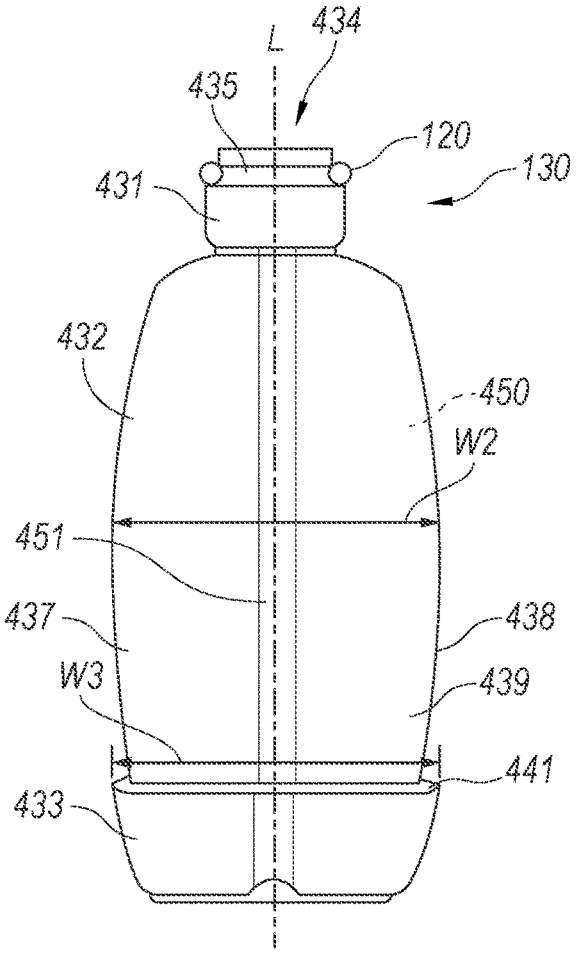

FIG. 4A is a side view and FIG. 4B is a front view of the liquid container 130 configured in accordance with an embodiment of the present technology. Referring to FIGS. 4A and 4B together, the liquid container 130 includes a neck 431, a body 432, and a base 433 that define an interior chamber 450 configured to hold a liquid (water; hair gel; mousse; hair mask; shampoo; conditioner; tea tree oil; lotion; other hair, fur, and/or fiber liquid products; and/or other liquids).

The neck 431 of the liquid container 130 is generally circular and includes an annular recess 435 configured to receive an O-ring 120 (partially shown). In other embodiments, the neck 431 can have more than one recess 435, each configured to receive an O-ring 120. In still other embodiments, the neck 431 can include threads configured to engage complimentary threads (not shown) within the handle 106 in addition to or in lieu of the recess 435. In the illustrated embodiment, the neck 431 defines a mouth or opening 434 of the chamber 450.

As shown in FIG. 4B, the body 432 can have sides 437 and 438 that are generally curved outwardly with respect to a longitudinal axis L of the liquid container 130 such that the body 432 has a maximum width W2. In other embodiments, the side(s) 437 and 438 can be straight and/or have a different contour. As best shown in FIG. 4A, the body 432 can have a height H2 between a front side 439 and a back side 440. In this embodiment, the width W2 and the height H2 generally correspond to (but are slightly less than) the width W1 and the height H1 of the opening 329 of the cavity 323 in the handle 106 such that the mouth 331 and the body 332 of the liquid container 130 can fit within the cavity 323 of the handle 106.

The base 433 has a height H3 (FIG. 4A) and a width W3 (FIG. 4B) near where the body 432 meets the base 433. In this embodiment, the height H3 and the width W3 are larger than the height H1 and the width W1, of the opening 329 in the handle 106 (FIG. 2) so that the liquid container 130 includes a step surface 441 that is configured to abut against the handle 106 at the opening 329 (FIG. 2) to prevent the liquid container 130 from being inserted into the handle 106 beyond the surface 441. In these and other embodiments, the base 433 is configured to remain external to the handle 106 and/or can be transparent to, for example, (i) provide a visual indication of how much liquid remains within the liquid container 130, and/or (ii) allow the user to push and/or to pull the liquid container 130 into and/or out of the handle 106 using the base 433. In these and still other embodiments, the base 433 can remain external to the handle 106 to display, for example, a label showing the user a brand and/or manufacturer of the liquid container 130 and/or a type of liquid in the liquid container 130.

Although the body 432 and the base 433 are shown with a generally rectangular cross-sectional shape, in other embodiments the body 432 and/or the base 433 of liquid container 130 can have different shapes (e.g., circular, triangular, etc.). In these and other embodiments, the body 432 and/or the base 433 can have different and/or varying dimensions (e.g., width W2, width W3, height H2, and/or height H3) in relation to the dimensions of the cavity 323 and/or in relation to one another. For example, the base 433 can be sized and shaped such that the base 433 can extend within the cavity 323.

As best shown in FIG. 4B, the body 432 includes a recess 451 (e.g., a groove or channel) on the front side 439 and a corresponding recess (not shown) on the back side 440 that extend parallel to the longitudinal axis L from proximate the base 433 to proximate the neck 431. The recesses 451 are configured to align with and receive the ridges 327 (FIG. 2) when the container 130 is inserted into the cavity 323 in the handle 106. In other embodiments, the recesses 451 can extend along the neck 431 and/or the base 433 in addition to or in lieu of the body 432. In these and other embodiments, the container 130 can include recesses 451 at other locations on the liquid container 130, such as on the sides 437-440. In these and other embodiments, the liquid container 130 can include ridges (not shown) in addition to or in lieu of the recesses 451.

Figure 6:
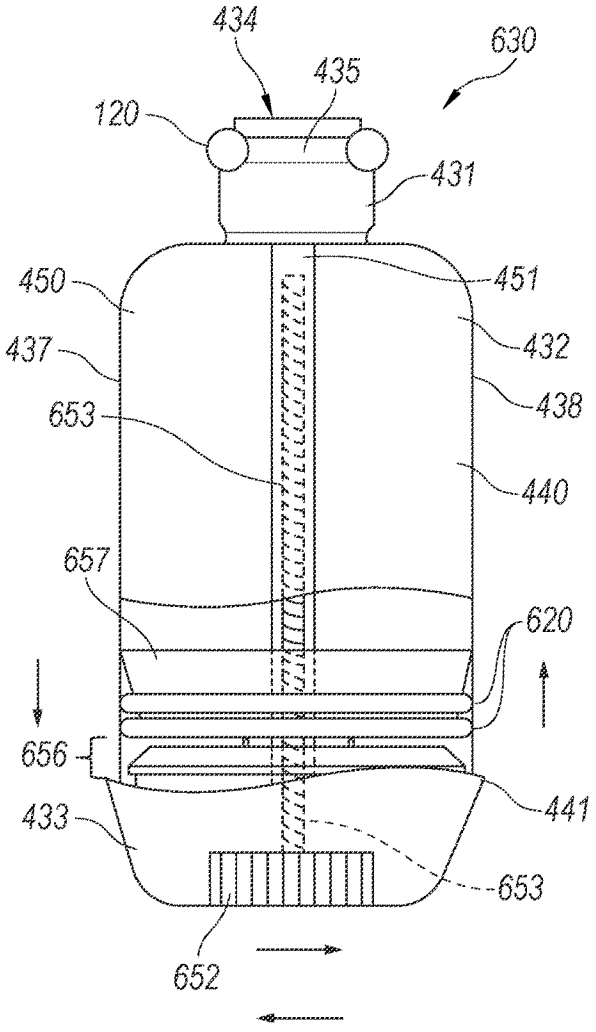
FIG. 6 is a partially cut away front view of a liquid container configured in accordance with another embodiment of the present technology.
Figure 5:
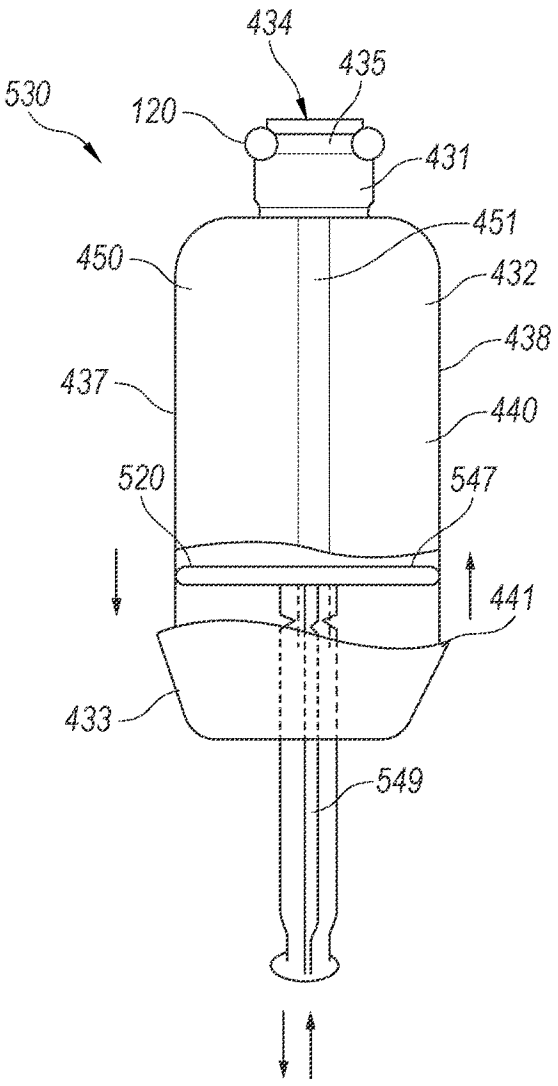
FIG. 5 is a partially cut away front view of a liquid container configured in accordance with an embodiment of the present technology.

In some embodiments, the liquid container 130 can include additional features to facilitate forcing liquid out of the container chamber 450. For example, FIGS. 5 and 6 are partially cut-away front views of liquid containers 530 and 630, respectively, configured in accordance with embodiments of the present technology. Referring first to FIG. 5, the liquid container 530 is generally similar to the liquid container 130 described in detail above with the exception that (i) the body 432 has a constant cross section and (ii) the liquid container 530 includes a plunger 549 having a piston 547. The piston 547 can be configured to slide along the interior surfaces the liquid container 530 and can include an O-ring 520 to inhibit liquid found at the piston from moving beneath the piston 547. As shown by arrows illustrated in FIG. 5, the plunger 549 can be actuated toward (e.g., pushed into) the liquid container 530 to force liquid forward of the plunger out of the chamber 450 through the mouth 434. In some embodiments, the plunger 549 can be actuated (e.g., pulled) away from the liquid container 530 to draw liquid into the chamber 450 for use.

Referring next to FIG. 6, the liquid container 630 is generally similar to the liquid containers 130 and 530 described above with the exception that (i) the body 432 has a constant cross section and (ii) the liquid container 630 includes a knob 652 operably coupled to a worm screw 653 that drives a piston 657. The piston 657 slide along interior surfaces of the sides 437-440 of the liquid container 630 and can include one or more O-rings 620 such that liquid in the chamber 450 is inhibited from moving behind the piston 657. The worm screw 653 extends from the chamber 450 and the piston 657 to the knob 652 where it is fixedly attached to the knob 652. The worm screw 653 is threaded such that (i) when a user turns the knob 652 in one direction, the worm screw 653 drives the piston 657 toward the mouth 434 and (ii) when the user turns the knob 652 in the other direction, the worm screw 653 drives the piston 657 toward a base portion 656 (as shown by arrows illustrated in FIG. 6). As the worm screw 653 drives the piston 657 toward the mouth 434, the piston 657 forces liquid in the chamber 450 out of the mouth 434.

In other embodiments, the piston 547 and/or the piston 657 can be connected to a lever (not shown) that extends to an exterior of the liquid containers 530 and/or 630. The lever can be actuated such that liquid within the chamber 450 is forced out of the mouth 434. In other embodiments, the liquid containers 530 and/or 630 can include an air pump (not shown). The air pump can be actuated to force air into the chamber 450 (e.g., beneath a piston and/or beneath liquid within the chamber 450), such that the air forces liquid within the chamber 450 out of the mouth 434.

Figure 7A:
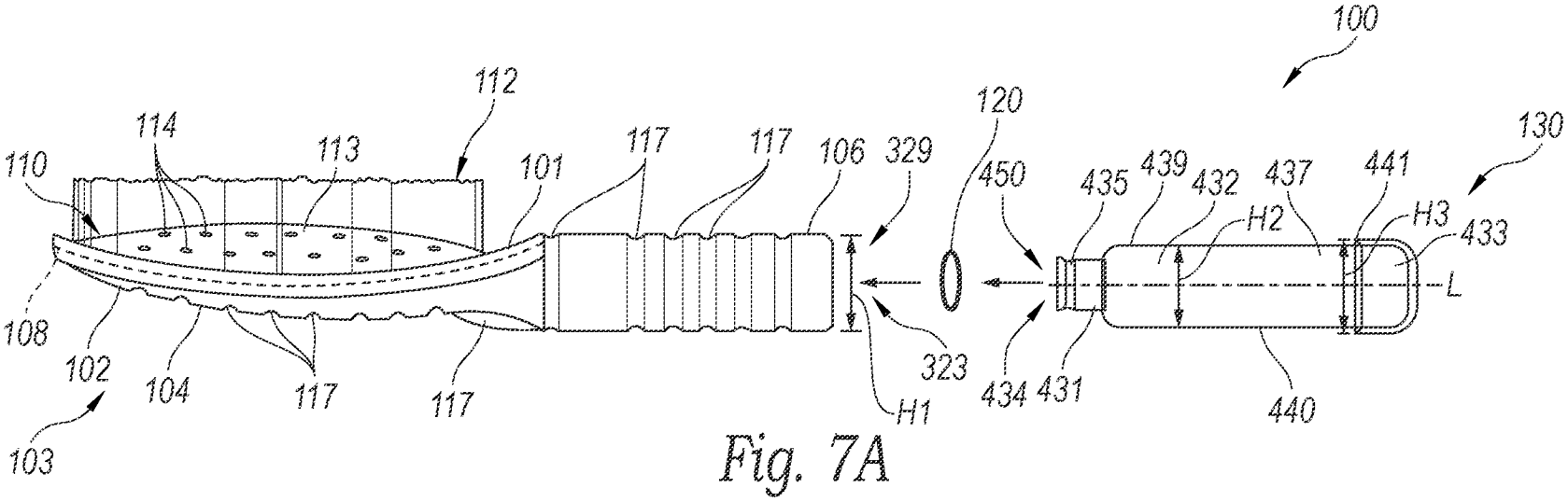
FIG. 7A is a partially exploded side view of the liquid dispensing hairbrush system of FIGS. 1A-1D configured in accordance with an embodiment of the present technology.

FIG. 7A is a partially exploded side view of the liquid dispensing hairbrush system 100 of FIGS. 1A-1D configured in accordance with an embodiment of the present technology. The annular recess 435 in the liquid container 130 is configured to receive the O-ring 120. The handle 106 of the brush body 103 is configured to receive the liquid container 130 in the cavity 323 via the opening 329 and the container is pushed forward until the O-ring 120 is received in an annular recess found in the handle, as discussed below.

Figure 7B:
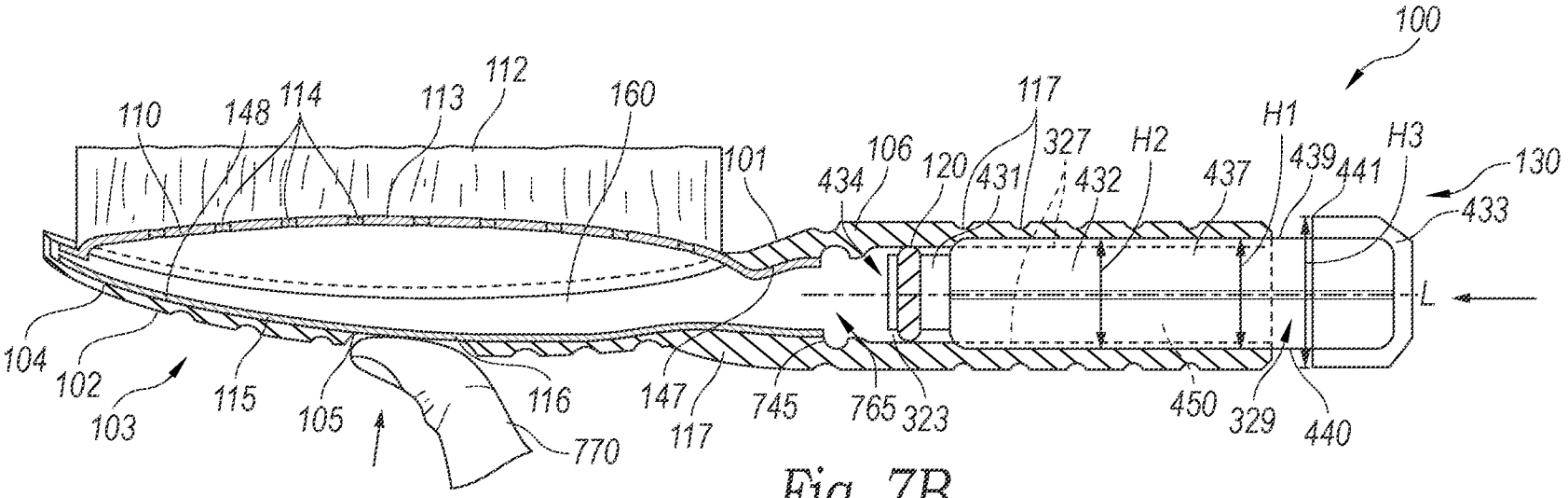
FIGS. 7B and 7C are partial cross-sectional side views taken along line 7-7 in FIG. 1B.
Figure 7C:
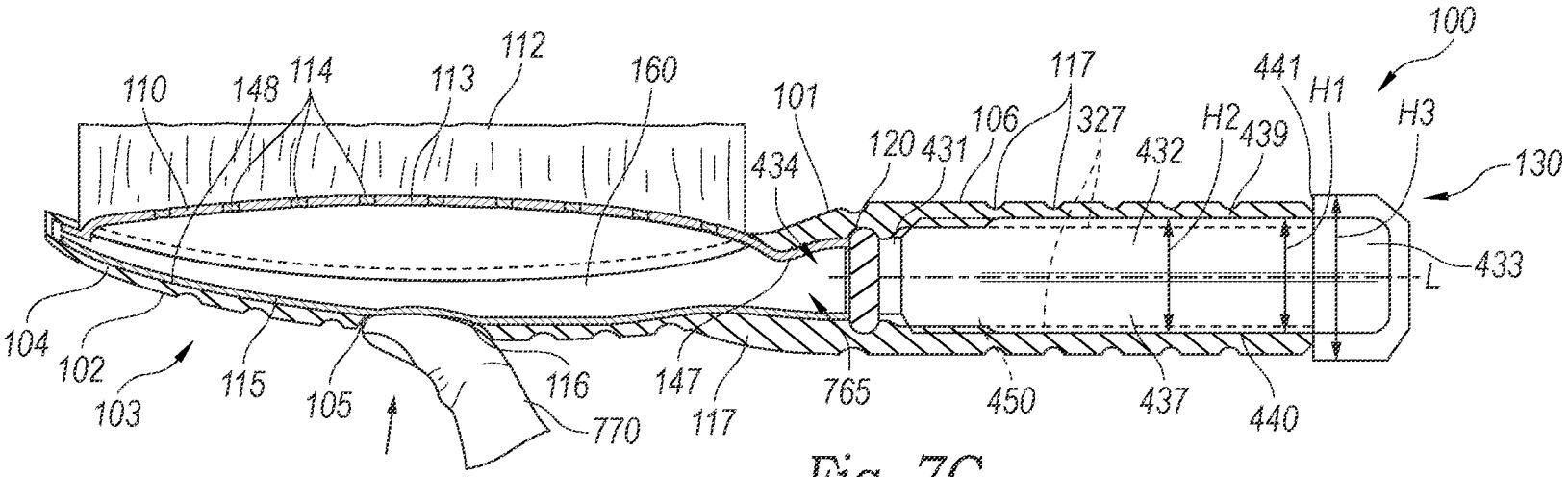

FIGS. 7B and 7C are partial cross-sectional side views along lines 7B-7B and 7C-7C, respectively, in FIG. 1B of the brush body 103. For clarity, a side view of the liquid container 130 is illustrated in FIGS. 7B and 7C rather than a cross-sectional side view. Referring to FIGS. 7B and 7C together, the liquid container 130 can be inserted into the cavity 323 in the handle 106. As shown, the brush body 103 includes an annular recess or seat 745 (FIG. 7B) configured to receive the O-ring 120. When the O-ring 120 is positioned with the seat 745, the O-ring 120 creates (i) a vacuum seal between the chamber 450 of the liquid container 130 and the chamber 160 of the brush head 104 and/or (ii) a watertight seal between the chambers 450 and 160 and the cavity 323.

As best shown in FIG. 7C, the chamber 160 is configured to be in fluid communication with the chamber 450 when the liquid container is inserted into the cavity 323 of the handle 106. The stepped surface 441 of the liquid container 130 abuts against the handle 106 at the opening 329 and prevents the liquid container 130 from being inserted too far into the brush body 103. In some embodiments, the O-ring 120 and the seat 745 can retain the liquid container 130 in the cavity 323.

Although the brush body 103 is configured to receive the liquid container 130 in the cavity 323 of the handle 106, hairbrush systems configured in accordance with other embodiments can have different configurations. For example, the handle 106 in other embodiments can include multiple components, such as a front side (not shown) and a back side (not shown). In these embodiments, the front side can be at least partially detached from the back side to permit installation of the liquid container 130. In an assembled state, the front side of the handle 106 can be clipped, snapped, and/or otherwise connected to the back side of the handle 106 about the liquid container 130. In other embodiments, the liquid container 130 can be attached to the back side 102 of the brush head 104 and configured to introduce liquid into the chamber 160 of the brush head 104 via the aperture 105 and/or one or more other apertures (not shown) in the back side 102 of the brush head 104.

Referring again to FIGS. 7B and 7C together, at the edge of the seat 745 nearest the brush head 104 (*i*) the bristle support layer 110 is attached to the inside surface 147 of the brush head 104 and (ii) the bladder 115 is attached to the inside surface 148 of the brush head 104. As discussed above, the bristle support layer 110 and/or the bladder 115 can be attached to the surfaces 147 and/or 148 using an adhesive (not shown) and/or one or more other attachment methods (e.g., along the periphery of the bristle support layer 110 and/or the bladder 115). In the illustrated embodiment, the bristle support layer 110 and the bladder 115 are attached to one another all the way around the brush body 103 proximate the edge of the seat 745 to form an opening 765 through which liquid can enter into and/or exit out of the chamber 160. In other embodiments, the bristle support layer 110 and the bladder 115 are not attached to one another at the edge of the seat 745 but are attached to the surfaces 147 and 148 such that the bristle support layer 110 and the bladder 115 form the opening 765 with a portion of the surface 147 and/or of the surface 148 of the brush body 103. In still other embodiments, the bristle support layer 110 and/or the bladder 115 can be attached to the brush body 103 and/or to one another at different locations, such as within the cavity 323 in the handle 106 or at a point closer to the aperture 105 in the brush head 104 from the edge of the seat 745.

In operation, the liquid container 130 is configured to transfer liquid from the chamber 450 to the chamber 160 of the brush head 104 at a suitable rate as the user brushes their hair. For example, the liquid container 130 can transfer liquid to the chamber 160 using gravity (e.g., when the hairbrush system 100 is tilted). In some embodiments, the liquid container 130 can transfer liquid to the chamber 160 using suction that is created when, for example, the bristle support layer 110 is decompresses and/or when the bladder 115 expands after a user compresses the bristle support layer 110 and/or presses on the bladder 115 through the aperture 105 in the back side 102 of the brush head 104. In other embodiments, the liquid container 130 can transfer liquid to the chamber 160 using capillary action (e.g., via a tube (not shown) that extends from the chamber 450 to a sponge in the brush head 104). In some embodiments, a portion (e.g., the body 432 and/or the base 433) of the liquid container 130 and/or a portion of the brush body 103 (e.g., the handle 106 and/or the back of the brush head 104) can be compressible such that liquid is transferred from the chamber 450 the brush head 104 when the liquid container 130 is compressed. In still other embodiments, a user can transfer liquid from the chamber 450 to the chamber 160 by actuating mechanical components such as the plunger 549, the knob 552, a lever, and/or an air pump.

After liquid enters the chamber 160 in the brush head 104, a user can force the liquid out of the chamber 160 and onto the bristles 112. For example, a user can apply pressure to the bristle support layer 110 (e.g., by applying pressure to the bristles 112), which can compress the bristle support layer 110 and drive liquid in the chamber 160 through the apertures 114 in the bristle support layer 110. In some embodiments, the hairbrush system 100 can be configured to release more liquid out of the chamber 160 as a user increases and/or reapplies pressure to the bristle support layer 110. In these and other embodiments, a user can press the portion 116 of the bladder 115 exposed through the aperture 105 in the back side 102 of the brush head 104 toward the front side 101 of the brush body 103 using, for example, their thumb 770 to force liquid in the chamber 160 through the apertures 114. In these and other embodiments, liquid can be forced out of the chamber 160 by, for example, actuating the mechanical components of the liquid container 130 and/or compressing the liquid container 130. Once a user transfers liquid to the front side 113 of the bristle support layer 110, the user can apply the liquid to and/or brush the liquid through their hair (e.g., using the bristles 112).

Figure 8:
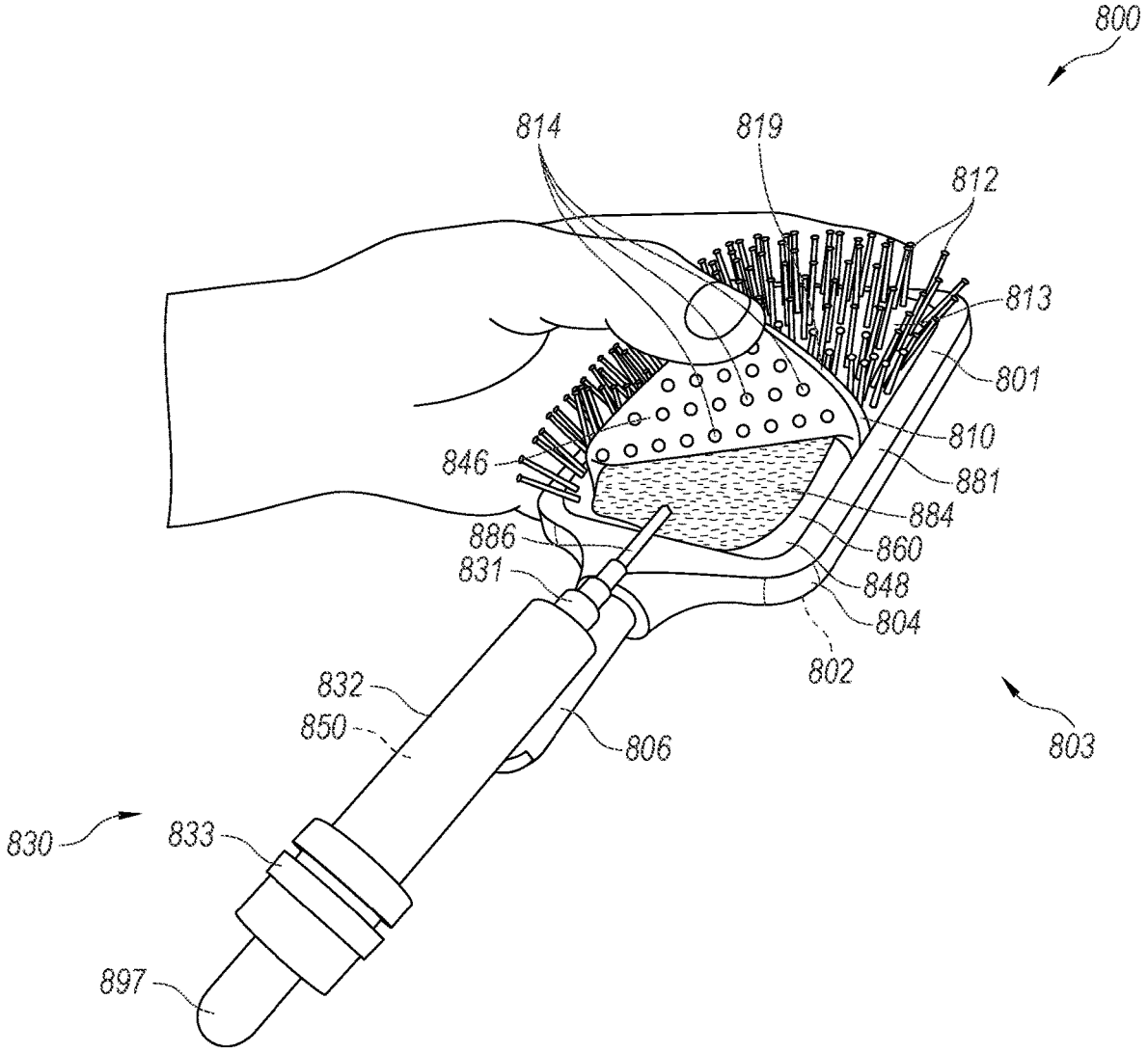
FIG. 8 is an isometric view illustrating a liquid dispensing hairbrush system configured in accordance with an embodiment of the present technology.

FIG. 8 is an isometric view illustrating a liquid dispensing hairbrush system 800 configured in accordance with another embodiment of the present technology. The system includes a brush body 803, a bristle support layer 810, a liquid container 830, a sponge 884, and a tube 886. The brush body 803 includes a brush head 804, a handle 806, and an edge member 881. The edge member 881 can engage (e.g., snap, clip, clamp, etc.) with the brush head 804 at a front side 801 of the brush head 804 to secure the bristle support layer 810 between the edge member 881 and the brush head 804 and to form a watertight seal along the periphery edges of the bristle support layer 810 (e.g., in a manner similar to the edge member 218 and the brush head 104 illustrated in FIG. 2). In some embodiments, an adhesive can be used to secure the bristle support layer 810, the edge member 881, and/or the brush head 804 together and/or (ii) to form and/or reinforce the watertight seal. In these and other embodiments, the edge member 881 and the brush head 804 can clamp at least a portion of the handle 806 to secure the handle 806 between the edge member 881 and the brush head 804.

In the illustrated embodiment, the bristle support layer 810 is a unitary piece of polymer material (e.g., rubber, plastic, etc.) and is similar to the bristle support layer 110 (FIG. 1). For example, the bristle support layer 810 includes one or more apertures 814 passing from a front side 813 to a back side 846 of the bristle support layer 810. A plurality of bristles 812 extend outwardly from the front side 813 of the bristle support layer 810 about the apertures 814. The bristle support layer 810 can be folded and/or flexed to fit between the edge member 881 and the brush head 804. In some embodiments, the bristle support layer 810 can be removable (i) so that a user can clean the bristle support layer 810 and/or the brush head 804 and/or (ii) so that a user can replace the bristle support layer 810. In the illustrated embodiment, the bristle support layer 810 and the brush head 804 define a chamber 860 in the brush body 103.

The sponge 884 is positioned within the chamber 860. In some embodiments, the sponge 884 can be attached to an interior surface 848 of the brush body 803 (e.g., using an adhesive and/or another attachment method). In these and other embodiments, the sponge 884 can be attached to the back side 846 of the bristle support layer 810, to the edge member 881, and/or to the handle 106. As described in greater detail below, the sponge 884 is configured to receive liquid from the liquid container 830 and to absorb and distribute the liquid throughout the chamber 860 (e.g., to the apertures 814 in the bristle support layer 810). In some embodiments, the sponge 884 can be removable so that a user can clean and/or replace it.

In the illustrated embodiment, the liquid container 830 is an extension of the handle 106. As shown, the liquid container 830 includes a neck 831, a body 832, and a base 833 that each have a generally circular cross section. The neck 831 is connected to the tube 886, which extends between the neck 831 and the sponge 884. The body 832 defines an interior chamber 850 that is configured to hold a liquid (e.g., water, hairspray, hair gel, mousse, hair mask, shampoo, conditioner, tea tree oil, lotion, and other hair, fur, and/or fiber liquid products). In these and other embodiments, the chamber 850 can be configured to hold other fluids and/or liquids.

As shown, the base 833 includes a bulb 897 attached to the base 833. The bulb 897 can be made of a polymer material (e.g., rubber, plastic, etc.). In the illustrated embodiment, the bulb 897 is configured to force fluid into the tube 886 when it is compressed by forcing fluid (e.g., liquid and/or air) into the body 832. In other embodiments, the base 833 can include an air pump (not shown) in lieu of the bulb 897. The air pump can be configured to operate in a generally similar manner as the bulb 897 except that the air pump is configured to draw air into the chamber 850 (e.g., via a valve) as it expands after being compressed. As a result, the air pump can force an increasing volume of air into the chamber 850 (e.g., through multiple compressions) until the liquid in the chamber 850 is depleted and/or exhausted. In these and other embodiments, the body 832 of the liquid container 830 can be compressed, which can force liquid into the sponge 884 via the tube 886. In these and still other embodiments, liquid from the chamber 850 can be transferred to the sponge 884 via capillary action and/or suction (e.g., after a user compresses the bristle support layer 810, as described in greater detail below).

In operation, a user can force liquid out of the chamber 860 and onto the bristles 812 via the apertures 814 in the bristle support layer 810. For example, a user can force liquid out of the chamber 860 by compressing the bulb 897, the air pump, and/or the liquid container 830. In these and other embodiments, a user can force liquid out of the apertures 114 by applying pressure to the bristle support layer 810 and/or to the sponge 884 (e.g., via the bristles 812). In these and still other embodiments, the brush head 804 of the brush head 804 can include an aperture (not shown) similar to the aperture 105 (FIG. 1C), for example, passing from a back side 802 of the brush head 804 and into the chamber 860 (e.g., beneath the sponge 884). In these embodiments, the hairbrush system 800 can include a bladder (not shown) beneath the sponge 884 and attached (e.g., glued) to the inside surface 848 of the brush head 804 along the periphery of the bladder 115 to prevent liquid from leaking out of the chamber 860 via the aperture in the brush head 804. A portion (not shown) of the bladder similar to the portion 116 (FIG. 1C) can be exposed through the aperture, and a user can press the portion to apply pressure to liquid in the chamber 860 and to force the liquid through the apertures 814 in the bristle support layer 810. Once a user transfers liquid to the front side 813 of the bristle support layer 810, the user can apply the liquid to and/or brush the liquid through their hair (e.g., using the bristles 812).

B. EXAMPLES

Several aspects of the present technology are set forth in the following examples.

1. A hairbrush, comprising:
   a brush body, the brush body including—
   a brush head having a first opening, and
   a handle having a cavity with a second opening;
   a bristle support layer having one or more apertures therein, wherein the bristle support layer is disposed over the first opening; and
   a liquid container configured to fit within the cavity via the second opening, wherein the hairbrush is operable to transfer liquid from the liquid container to the brush head and through the one or more apertures in the bristle support layer.
2. The hairbrush of example 1, wherein the liquid container is configured to transfer liquid therein to the brush head.
3. The hairbrush of example 2, further comprising a piston operably disposed within the container and configured to drive the liquid therein to the brush head and through the one or more apertures in the bristle support layer.
4. The hairbrush of example 3, further comprising a drive screw operably coupled to the piston, wherein the drive screw is manually operable to drive the piston toward an outlet in the container.
5. The hairbrush of example 2, further comprising a pump operably coupled to the container and manually operable to drive the liquid therein to the brush head and through the one or more apertures in the bristle support layer.
6. The hairbrush of example 1, wherein the handle is compressible to drive liquid in the container into the brush head and through the one or more apertures in the bristle support layer.
7. The hairbrush of example 1, further comprising a sponge positioned within the brush head, wherein the sponge is configured to distribute the liquid to the one or more apertures in the bristle support layer.
8. The hairbrush of example 1, wherein:
   the cavity includes one or more protrusions; and
   the liquid container includes one or more grooves configured to receive the one or more protrusions when the liquid container is inserted into the cavity.

9. The hairbrush of example 1, wherein the brush head further includes a third opening in a back side thereof opposite the first opening, wherein the hairbrush further comprises a bladder across the third opening, and wherein the bladder is manually depressible to drive liquid within the brush head through the one or more apertures in the bristle support layer.
10. The hairbrush of example 1, wherein the liquid container includes a base that is larger than the second opening.
11. The hairbrush of example 1, further comprising an O-ring, wherein— the liquid container includes an annular recess configured to receive the O-ring; and the brush body further includes a seat configured to receive the O-ring.

12. A liquid container, comprising:

a body having a mouth;

wherein the body defines a chamber configured to contain liquid, and wherein the body is sized and shaped to be received within a cavity of a hairbrush.

13. The liquid container of example 12, wherein the body includes one or more first features, and wherein the first features are configured to engage corresponding second features in the cavity of the hairbrush.
14. The liquid container of example 12, further comprising a neck having an annular recess configured to receive an O-ring.
15. The liquid container of example 12, further comprising a neck having threading, and wherein the threading corresponds to threading in the cavity of the hairbrush.
16. The liquid container of example 12, further comprising a base having a first dimension greater than a corresponding second dimension of an opening to the cavity of the hairbrush.
17. The liquid container of example 12, further comprising a piston operably disposed within the chamber and configured to drive the liquid therein toward the mouth.
18. The liquid container of example 17, further comprising a drive screw operably coupled to the piston, wherein the drive screw is manually operable to drive the piston toward the mouth.
19. The liquid container of example 12, further comprising a pump operably coupled to the container and manually operable to drive the liquid therein toward the mouth.
20. The liquid container of example 12, wherein at least a portion of the body is compressible to drive the liquid in the chamber toward the mouth.
21. A hairbrush, comprising:

a brush head; and a bristle support layer attached to the brush head, wherein the brush head is configured to be operably coupled to and in fluid communication with a liquid container.

22. The hairbrush of example 21, wherein the bristle support layer includes a plurality of apertures and a plurality of bristles extending outwardly therefrom proximate the plurality of apertures.
23. The hairbrush of example 21, further comprising an edge member configured to attach the bristle support layer to the brush head.
24. The hairbrush of example 21, wherein the brush head includes an aperture in a back side thereof, and wherein the hairbrush further comprises a depressible bladder positioned within the brush head and across the aperture.
25. The hairbrush of example 21, further comprising an O-ring sealably disposed between the liquid container and the brush head.
26. The hairbrush of example 11, further comprising a handle extending from the brush head, wherein the handle includes a cavity configured to receive the liquid container.
27. The hairbrush of example 26, wherein the cavity includes a proximal end portion proximate the brush head and a distal end portion opposite the proximal end portion, and wherein the distal end portion includes an opening configured to receive the liquid container.
28. The hairbrush of example 26, wherein— the handle includes a front portion and a back portion; and the front portion is configured to engage to the back portion about the liquid container when the liquid container is positioned in the cavity.

29. The hairbrush of example 26, wherein at least a portion of the handle is compressible to drive liquid in the liquid container into the brush head.

C. CONCLUSION

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. Furthermore, the various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. To the extent any material incorporated herein by reference conflicts with the present disclosure, the present disclosure controls. Where the context permits, singular or plural terms may also include the plural or singular term, respectively. Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. Furthermore, as used herein, the phrase "and/or" as in "A and/or B" refers to A alone, B alone, and both A and B. Additionally, the terms "comprising," "including," "having" and "with" are used throughout to mean including at least the recited feature(s) such that any greater number of the same feature and/or additional types of other features are not precluded.

From the foregoing, it will also be appreciated that various modifications may be made without deviating from the technology. For example, various components of the technology can be further divided into subcomponents, or that various components and functions of the technology may be combined and/or integrated. Furthermore, although advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A hairbrush, comprising:

a brush body, the brush body including— a brush head having a front side, a back side opposite the front side, a first opening at the front side, and a second opening at the back side opposite the first opening, and a handle having a cavity with a third opening;

a bristle support layer having one or more apertures therein, wherein the bristle support layer is disposed over the first opening;

a bladder positioned at least partially between the brush head and the bristle support layer, wherein the bladder extends across the second opening such that at least a portion of the bladder is exposed at the back side of the brush head through the second opening; and a liquid container configured to fit within the cavity via the third opening, wherein:

the bladder and the bristle support layer at least partially define a chamber therebetween, the one or more apertures extend from a first side of the bristle support layer interior the chamber to a second side of the bristle support layer opposite the first side and exterior the chamber, and the hairbrush is operable to transfer liquid from the liquid container to the chamber and through the one or more apertures in the bristle support layer in response to pressure applied to the bladder via the second opening.

2. The hairbrush of claim 1, wherein the liquid container is configured to transfer liquid therein to the chamber.

3. The hairbrush of claim 2, further comprising a piston operably disposed within the container and configured to drive the liquid therein to the chamber and through the one or more apertures in the bristle support layer.

4. The hairbrush of claim 3, further comprising a drive screw operably coupled to the piston, wherein the drive screw is manually operable to drive the piston toward an outlet in the container.

5. The hairbrush of claim 2, further comprising a pump operably coupled to the container and manually operable to drive the liquid therein to the chamber and through the one or more apertures in the bristle support layer.

6. The hairbrush of claim 1, wherein the handle is compressible to drive liquid in the container into the chamber and through the one or more apertures in the bristle support layer.

7. The hairbrush of claim 1, further comprising a sponge positioned within the chamber, wherein the sponge is configured to distribute the liquid to the one or more apertures in the bristle support layer.

8. The hairbrush of claim 1, wherein:

the cavity includes one or more protrusions; and the liquid container includes one or more grooves configured to receive the one or more protrusions when the liquid container is inserted into the cavity.

9. The hairbrush of claim 1, wherein the liquid container includes a base that is larger than the second opening.

10. A hairbrush, comprising:

a brush head having a front side, a back side opposite the front side, and an opening at the front side;

a bristle support layer attached to the brush head and disposed over the opening, wherein the bristle support layer and the brush head at least partially define a chamber therebetween, and wherein the bristle support layer includes a plurality of apertures extending from a first side of the bristle support layer interior the chamber to a second side of the bristle support layer opposite the first side and exterior the chamber; and a sponge positioned between the brush head and the bristle support layer and within the chamber, wherein the brush head is configured to be operably coupled to and in fluid communication with a liquid container, and wherein the sponge is configured to distribute liquid received from the fluid container to the plurality of apertures in the bristle support layer.

11. The hairbrush of claim 10, wherein the bristle support layer includes a plurality of bristles extending outwardly therefrom proximate the plurality of apertures.

12. The hairbrush of claim 10, further comprising an edge member configured to attach the bristle support layer to the brush head.

13. The hairbrush of claim 10, wherein the brush head includes an aperture in a back side thereof, and wherein the hairbrush further comprises a depressible bladder positioned within the brush head and across the aperture.

14. The hairbrush of claim 10, further comprising an O-ring sealably disposed between the liquid container and the brush head.

15. The hairbrush of claim 10, further comprising a handle extending from the brush head, wherein the handle includes a cavity configured to receive the liquid container.

16. The hairbrush of claim 15, wherein the cavity includes a proximal end portion proximate the brush head and a distal end portion opposite the proximal end portion, and wherein the distal end portion includes an opening configured to receive the liquid container.

17. The hairbrush of claim 15, wherein— the handle includes a front portion and a back portion; and the front portion is configured to engage to the back portion about the liquid container when the liquid container is positioned in the cavity.

18. The hairbrush of claim 15, wherein at least a portion of the handle is compressible to drive liquid in the liquid container into the chamber.

19. A hairbrush system, comprising:

a brush body having a handle and a brush head attached to the handle, wherein the brush head includes a first side, a second side opposite the first side, and a first aperture in the second side, and wherein the brush head is configured to be operably coupled to and in fluid communication with a liquid container;

a bristle support layer attachable to the first side of the brush head such that the bristle support layer and the brush head at least partially define a chamber therebetween, wherein the bristle support layer includes a plurality of bristles extending outwardly therefrom, wherein bristles of the plurality of bristles are arranged in a plurality of rows and a plurality of columns on the bristle support layer, wherein the bristle support layer further includes one or more second apertures positioned adjacent bases of at least some of the bristles of the plurality of bristles, and wherein, at least when the bristle support layer is attached to the first side of the brush head, the one or more second apertures extend from a first side of the bristle support layer within the chamber to a second side of the bristle support layer opposite the first side and outside of the chamber; and a bladder at least partially positionable within the chamber such that the bladder extends across the first aperture in the second side of the brush head and is at least partially exposed at the second side of the brush head through the first aperture.

20. The hairbrush system of claim 19, further comprising a sponge positionable at least partially between the brush head and the bristle support layer and within the chamber, wherein the sponge is configured to distribute liquid received from the fluid container to the one or more apertures in the bristle support layer at least when the sponge is positioned at least partially between the brush head and the bristle support layer.

* * * * *